US005088935A

United States Patent [19]

Dise et al.

[11] Patent Number: 5,088,935

[45] Date of Patent: Feb. 18, 1992

[54] ELECTRICAL CONNECTOR PANEL

[75] Inventors: Ronald S. Dise, Perkasie; Ronald W. Phillips, II, Sellersville, both of Pa.

[73] Assignee: Penn Engineering & Manufacturing Corp., Danboro, Pa.

[21] Appl. No.: 681,006

[22] Filed: Apr. 5, 1991

[51] Int. Cl.[5] ..... H01R 13/623

[52] U.S. Cl. ..... 439/573; 439/557; 439/564

[58] Field of Search ..... 439/544, 557, 562, 564, 439/565, 571, 572, 573; 248/27.3

[56] References Cited

U.S. PATENT DOCUMENTS 4,634,203 1/1987 Noyes ..... 439/557 X
4,824,398 4/1989 Taylor ..... 439/557
4,895,535 1/1990 Femadi et al. ..... 439/552 X

*Primary Examiner*—Eugene F. Desmond
*Attorney, Agent, or Firm*—Gregory J. Gore

[57] ABSTRACT

An electrical connector panel incorporates a self-clinching type standoff fastener which is installed through mounting holes in the panel from the inside out. The fasteners include a knurled head sized so that excessive bulging of the metal around the panel D-shaped cutout does not develop when pressed into the panel. The head of the fastener is preferably installed flush with the inside of the panel to which the receptacle portion of the cable connector is fastened. With this construction, changes in panel thickness from one application to another will not alter the prescribed distance between the flanges of the mating cable plug and receptacle. Hence, an individual standoff part may be used for many different applications without the need for additional loose hardware.

12 Claims, 2 Drawing Sheets

FIG. 1
PRIOR ART
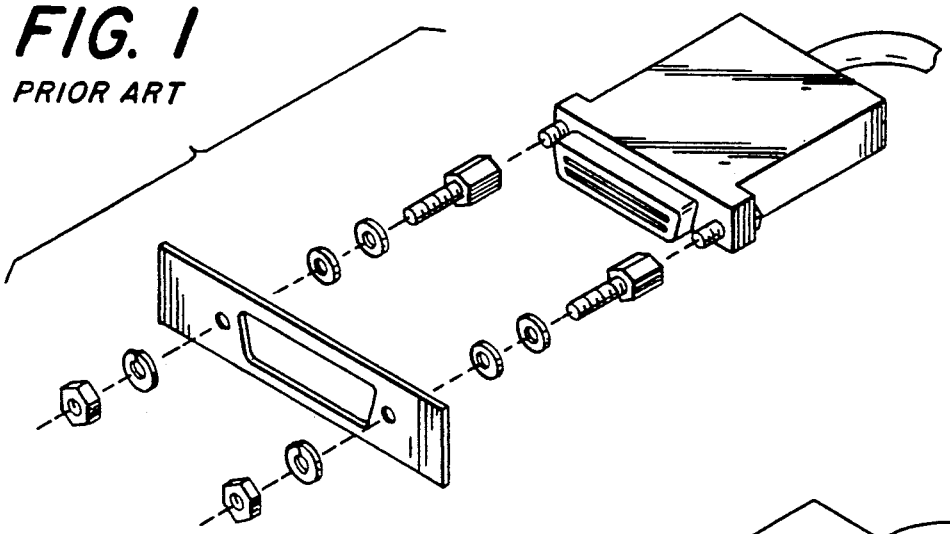
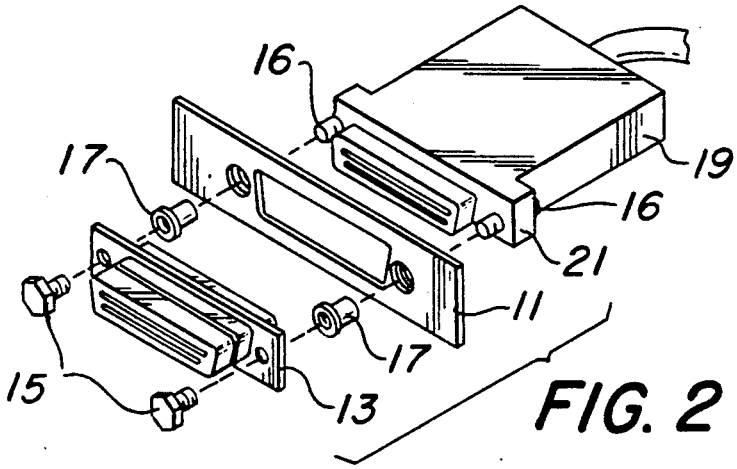
FIG. 2
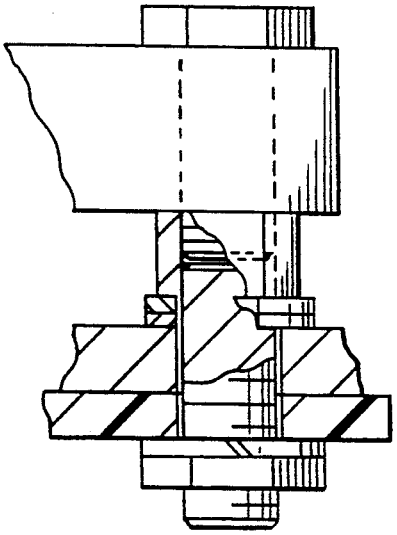
FIG. 1a
PRIOR ART
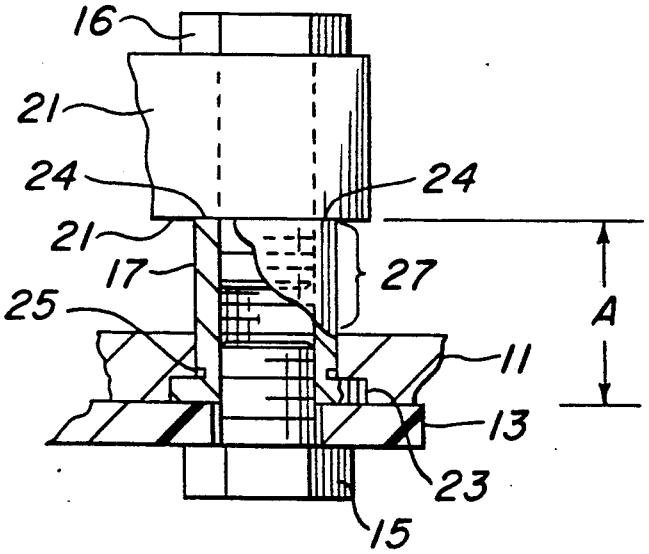
FIG. 2a FIG. 3
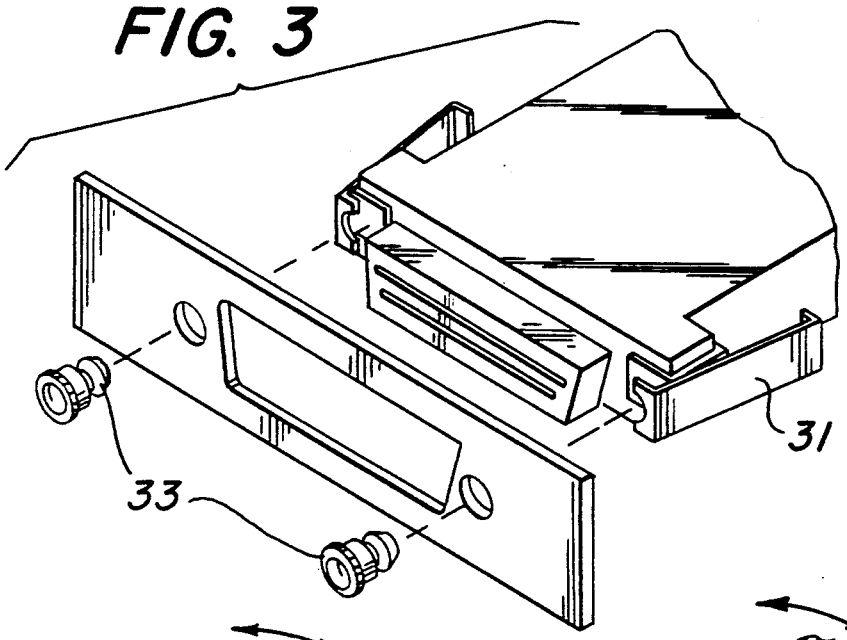
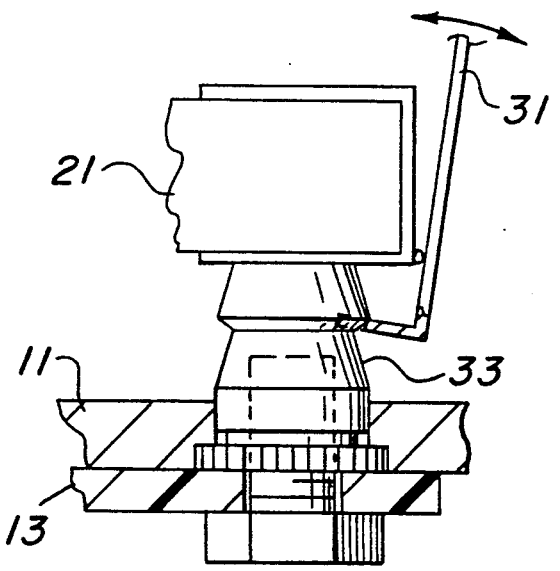
FIG. 4
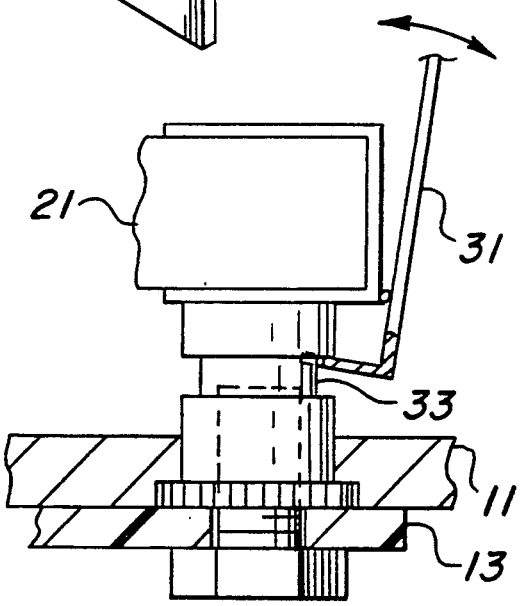
FIG. 5

ELECTRICAL CONNECTOR PANEL

FIELD OF THE INVENTION

This invention relates to electrical cable connectors which fasten to the outer chassis of electrical equipment, such as computer terminals. More specifically, it relates to an electrical connector junction chassis panel having permanently installed fastener means.

PRIOR ART AND BACKGROUND OF THE INVENTION

The electrical equipment in the computer industry typically uses internally and externally-threaded loose standoffs, spacer washers, lock washers and nuts to attach the electrical receptacle to the chassis and then the plug to the receptacle. FIG. 1 shows a typical assembly of parts found at the rear of the chassis for connecting incoming and outgoing electrical data cables. The connectors are multiple pin-and-socket receptacles and plugs which electrically interconnect and attach the data transmission cables from the computer chassis to related peripheral devices, such as printers, plotters or other computers. These connectors have a modified elongated "D" shape to ensure orientation in their mounting holes and also orientation with the mating plugs. They have become known as "D" connectors. Pin configuration shell sizes, mounting holes, and the like have been standardized throughout the world and all manufacturers meet these standards.

Because it was never anticipated that the chassis panel connectors would be used in the volume in which they are manufactured today, no attempt in the past has been made at using other than loose hardware to either attach the receptacle to the chassis or to attach the plug to the receptacle. The standardized mounting hole diameter cutout size, and center-to-center distance were established using loose hardware, typically a #40 screw and nut. Previous attempts at eliminating the loose hardware to provide fewer number of parts by using, for instance, permanently installed self-clinching fasteners in the existing chassis mounting holes met with failure due to the very minimal spacing between the screw hole and the connector cutout in the panel. To date, no attempt has been successful in installing a standoff into the chassis due to this limited edge distance.

Furthermore, there exists a problem in the art with accommodating different chassis panel thicknesses. It is important that the mounting flanges of the mating receptacle and plug be fastened the proper distance apart. If the length of the mounting standoff is too great, the plug will not be inserted deeply enough into the receptacle, thereby jeopardizing a proper electrical connection. On the other hand, if the length of the standoff is too short, the plug will bottom out against the receptacle and the plug flange may be bent or broken as the plug screw is tightened down to the shoulder of the standoff. Because in the existing art the standoff is located between the outside face of the panel and the plug, a change in panel thickness will vary the plug/-receptacle spacing. In order to achieve the proper standoff distance from the outside face of the panel, it is the usual practice in the art to vary the standoff length by adding or subtracting loose washers, such as those shown in FIG. 1.

SUMMARY OF THE INVENTION

The objects of the invention relate to reducing the overall costs of the cable connector panel of the type described above by both reducing the cost and number of the components and by creating a fastening system which reduces the labor intensity of installing the components.

Additionally, another object of the invention is to design a less expensive electrical connector panel, which includes permanently installed, standoff fasteners.

It is a further object of the invention to provide permanently installed standoff fastener for a electrical connector panel which is universal, accommodating different panel thicknesses without the need for utilizing additional hardware to compensate for changes in panel thickness.

The above-mentioned objects are accomplished by utilizing a specially designed self-clinching type standoff fastener which is installed through a mounting hole in the chassis panel from the inside out. The fastener includes a knurled head sized so that excessive bulging of the metal around the panel D-shaped cutout does not develop when pressed into the panel. The head of the fastener is installed flush with the inside of the panel to which the receptacle portion of the cable connector is fastened. The opposite end of the fastener functions as a shoulder which abuts the plug flange. Installed in this way, changes in panel thickness from one application to another will not alter the prescribed distance between the flanges of the mating cable plug and receptacle. Hence, an individual standoff part may be used for many different applications without the need for additional loose hardware.

The applicants have devised an electrical equipment chassis having a cable connector panel with inside and outside opposing faces, comprising:

(a) a panel affixed to said chassis having a receptacle cutout and fastener mounting holes;

(b) a standoff clinch-type fastener installed into the inside face of said panel, said fastener including a standoff portion extending beyond the outside face of said panel and without any portion which abuts the outside face of said panel;

(c) a pin-type electrical receptacle mounted by said fastener to the inside face of said panel and extending through said cutout;

(d) a standoff shoulder located at the end of said standoff portion of said fastener; and (e) an electrical plug mated with said receptacle and releaseably affixed to and abutting said standoff shoulder of said fastener.

The invention achieves the following advantages. The fastener utilizes clinch installation and, hence, there are no loose parts to fall into the interior of the chassis and cause malfunctions. The fastener is installed from the inside of the chassis and accommodates connector panels from 0.037 inches to 0.250 inches in thickness. A single fastener length thus maintains the proper distance of receptacle-to-plug regardless of panel thickness and ensures proper engagement of the electrical contacts. The invention reduces inventory and parts count in two ways: first, a one-piece standoff replaces one or more loose components; and, secondly, the need to stock different lengths of standoffs to accommodate different thicknesses of panels is eliminated. With the standoff clinched into place, the need for tools such as wrenches to hold the standoff while tightening plug screw is eliminated.

These and other advantages and objects of the invention will be apparent from the following drawings and description of the preferred embodiment.

BRIEF DESCRIPTION OF THE DRAWINGS

FIG. 1 is an exploded view of a prior art connector panel showing an assembly of parts typically utilized for securing mating connectors to a chassis panel.

FIG. 1*a* is a sectional view showing the relationship between the prior art standoff and the chassis panel.

FIG. 2 is an exploded view of an electrical connector panel of the invention showing the mating of connectors secured to the chassis panel as disclosed herein.

FIG. 2*a* is a sectional view showing the fastener of the invention installed into the chassis panel.

FIG. 3 is an exploded view showing the connector assembly of an alternate embodiment.

FIG. 4 is a side sectional view of the alternate embodiment panel fastener shown in FIG. 3.

FIG. 5 is an alternate embodiment of a fastener of the type shown in FIG. 4.

DETAILED DESCRIPTION OF THE PREFERRED EMBODIMENT

Referring to FIG. 2, an exploded view of the applicants' chassis panel connector system is shown. On the inside face of panel 11, electrical connector receptacle 13 is secured thereto by bolt means 15. Bolts 15 thread into fastener 17 which is clinched into the inside face of panel 11. The clinch head of fastener 17 is inserted flush with the inside face of panel 11. Similarly, bolts 16 thread into the standoff end of fastener 17 securing cable plug 19 thereto.

As shown more clearly in FIG. 2*a*, fastener 17 includes an elongated shank which passes through the mounting hole in panel 11 and provides a standoff shoulder at its end for holding the cable plug a given distance from receptacle 13.

Referring now to FIG. 2*a*, fastener 17 includes a knurled head 23 which is seated into the inside of metal panel 11 flush with the inside face of the panel. The fastener includes clinch groove 25 which accepts the cold flow of metal of panel 11 during insertion. The knurled head 23 of the fastener secures it against rotation and is of a proper diameter to prevent the bulging of metal into the D-shaped cutout of panel 11 during insertion. The standoff portion 27 of the fastener extends through the mounting hole in panel 11 and provides a standoff shoulder 24 at the lateral face at the end of the fastener which abuts the flange of the cable plug 29. In the embodiment shown in this figure, the standoff fastener is internally threaded all the way through to receive fastening screw means from both ends. Using this configuration, the receptacle and plug are both releaseably and individually secured to the panel by three fastening elements (two screws and the fastener standoff) on each side of the cable. It should be obvious to those of ordinary skill in the art that the standoff end of fastener 17 may include an extending threaded stud, rather than an internal thread. The stud would cooperate with nut means on the opposite side of the plug flange for attachment.

It will be readily apparent to those of ordinary skill in the art from the mechanical relations described above that the clinched head of fastener 17 at one end is in an abutting relationship to receptacle 13, while the opposite end of the fastener presents a flat lateral surface forming a shoulder 24 which abuts flange 21 of plug 19. Because the fastener does not abut the outside face of the panel, the distance A as shown in FIG. 2*a* between the receptacle and plug flange 21 is always equal to the length of fastener 17 regardless of the thickness of panel 11. Also, while the preferred embodiment shows the head of the fastener 17 installed flush with the inside face of the panel, it may be desirable in some applications to have the head protrude slightly from the inside face. This will also result in the proper spacing between the receptacle and plug flanges, regardless of panel thickness so long as the fastener is installed so that the protruding head is always the same distance from the inside face of the panel.

FIGS. 3, 4 and 5 show alternate embodiments of the present invention which include a clinch-type standoff fastener with a grooved shank which extends beyond the shoulder. As shown in these figures, these embodiments are used with plugs having side clasps 31 which clip into the grooves 33 at the end of the standoff.

It should be understood that the above description discloses specific embodiments of the present invention and are for purposes of illustration only. There may be other modifications and changes obvious to those of ordinary skill in the art which fall within the scope of the present invention which should be limited only by the following claims and their legal equivalents.

What is claimed is:

1. An electrical equipment chassis having a cable connector panel with inside and outside opposing faces, comprising:

(a) a panel affixed to said chassis having a receptacle cutout and fastener mounting holes;

(b) a standoff clinch-type fastener installed into the inside face of said panel, said fastener including a standoff portion extending beyond the outside face of said panel and without any portion which abuts the outside face of said panel;

(c) a pin-type electrical receptacle mounted by said fastener to the inside face of said panel and extending through said cutout;

(d) a standoff shoulder located at the end of said standoff portion of said fastener; and (e) an electrical plug mated with said receptacle and releaseably affixed to and abutting said standoff shoulder of said fastener.

2. The electrical equipment chassis of claim 1 wherein said fastener includes a head at one end having a knurled portion which is embedded into said panel to prevent rotation therebetween.

3. The electrical equipment chassis of claim 2 wherein said fastener is installed into said panel so that said head is flush with the inside face of said panel.

4. The electrical equipment chassis of claim 3 wherein said fastener includes an internally-threaded bore through the entire length of said fastener.

5. The electrical equipment chassis of claim 2 wherein said fastener includes a grooved shank which extends beyond said shoulder at the end of said fastener opposite said head.

6. The electrical equipment chassis of claim 5 wherein said electrical plug includes clips which engage said grooves in said fastener.

7. The electrical equipment chassis of claim 2 wherein said equipment is a computer terminal and said panel cutouts are D-shaped.

8. An electrical panel, comprising:

(a) a flat panel having first and second opposing faces and fastener mounting holes; and (b) a standoff clinch-type fastener installed into the first face of said panel and pressed into one of said fastener mounting holes so that a standoff portion of said fastener extends beyond said second face of said panel and no portion of said fastener abuts said second face of said panel.

9. The electrical connector panel of claim 8 wherein a head of said fastener includes a knurled portion which is embedded into said panel to prevent rotation therebetween.

10. The electrical connector panel of claim 9 wherein said fastener includes an internally-threaded bore through the entire length of said fastener.

11. The electrical connector panel of claim 9 wherein said head of said fastener is flush with said first face of said panel.

12. The electrical connector panel of claim 11 further including an electrical device releaseably secured to the standoff portion of said fastener.

* * * * *